United States Patent [19]

Bond et al.

[11] 4,267,580

[45] May 12, 1981

[54] CCD ANALOG AND DIGITAL CORRELATORS

[75] Inventors: James W. Bond; James M. Alsup; Jeffrey M. Speiser; Harper J. Whitehouse; Isaac Lagnado, all of San Diego, Calif.

[73] Assignee: The United States of America as represented by the Secretary of the Navy, Washington, D.C.

[21] Appl. No.: 1,516

[22] Filed: Jan. 8, 1979

[51] Int. Cl.[3] ..... G06G 7/19; G06J 1/00

[52] U.S. Cl. ..... 364/824; 364/604; 364/746; 364/862

[58] Field of Search ..... 364/728, 604, 746, 603, 364/819, 822, 824, 861, 862, 864

[56] References Cited

U.S. PATENT DOCUMENTS

| | | | |
|---|---|---|---|
| 3,670,151 | 6/1972 | Lindsay et al. | 364/824 |
| 3,774,019 | 11/1973 | Cook | 364/824 |
| 3,831,013 | 8/1974 | Alsup et al. | 364/604 |
| 3,935,439 | 1/1976 | Buss et al. | 364/824 |
| 3,940,602 | 2/1976 | Lagnado et al. | 364/864 |
| 3,987,292 | 10/1976 | Means | 364/603 |
| 4,032,767 | 6/1977 | Lagnado | 364/862 |
| 4,041,284 | 8/1977 | Bond | 364/604 |
| 4,052,606 | 10/1977 | Heller et al. | 364/862 |
| 4,156,924 | 5/1979 | Lampe et al. | 364/862 |

OTHER PUBLICATIONS

Bond: Improving the Accuracy of Analog Signal Processing Devices by Implementing Residue Class Arithmetic, Journees d'Electronique 1975, Lausanne, Switzerland.

Garner: The Residue Number System IRE Transactions on Electronic Computers Jun. 1959, pp. 140–147.

*Primary Examiner*—Felix D. Gruber

*Attorney, Agent, or Firm*—Richard S. Sciascia; Ervin F. Johnston; John Stan

[57] ABSTRACT

A charge-coupled device (CCD) analog and digital correlator comprises identical modules, each of which is a simple analog CCD correlator with digital input and output. Circuits are included:

(1) for injecting charges proportional to the voltage sequences s(n) and r(n), where s(n) refers to the input signal, and r(n) relates to a reference signal, against which the input signal is correlated;

(2) for non-destructively sensing and tapping each sample s(n) and r(n);

(3) for forming the summation s(n)+r(n);

(4) and finally for squaring s(n), r(n), and [s(n)+r(n)] in simple, floating gate MOSFET amplifiers. The amplifiers operate in their saturation region, and have outputs proportional to $s^2(n)$, $r^2(n)$, and $[s(n)+r(n)]^2$, which are then fed into a differential amplifier to produce s(n)r(n).

12 Claims, 12 Drawing Figures

AN ANALOG CONVOLVER/PROGRAMMABLE FILTER.

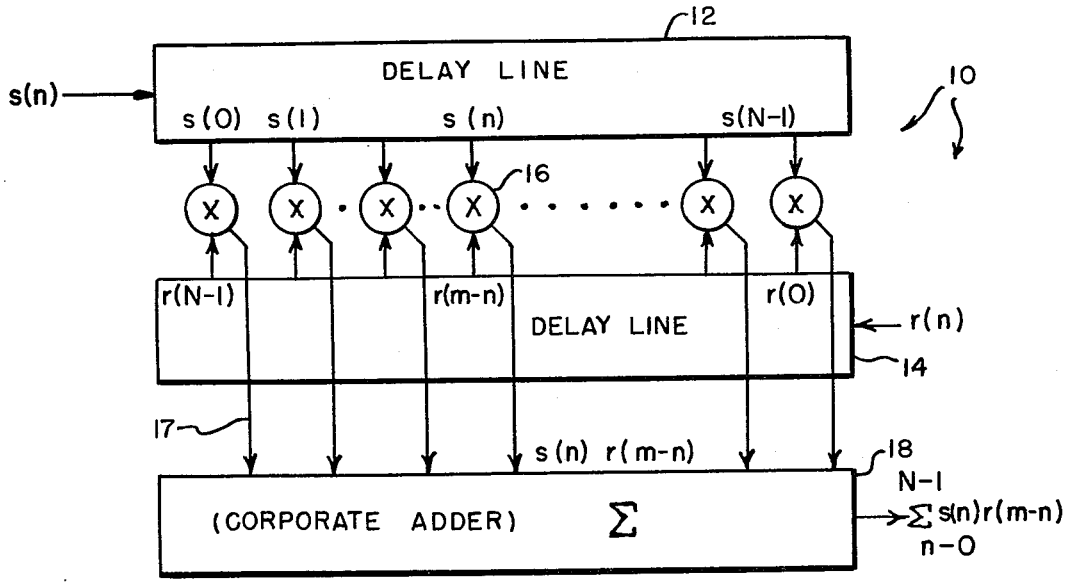
FIG. 1. AN ANALOG CONVOLVER/PROGRAMMABLE FILTER.
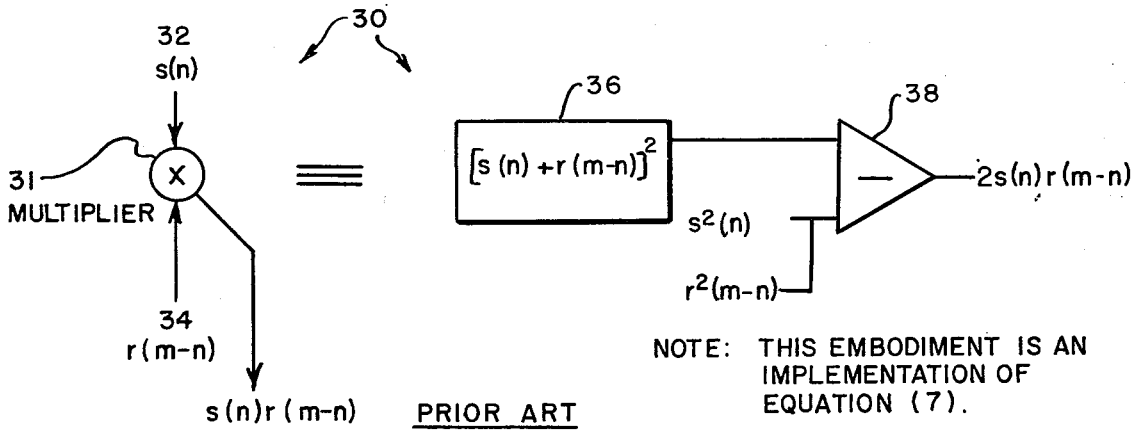
FIG. 2B. MULTIPLIER OPERATION PERFORMED BY A SQUARING DEVICE AND A DIFFERENTIAL AMPLIFIER.

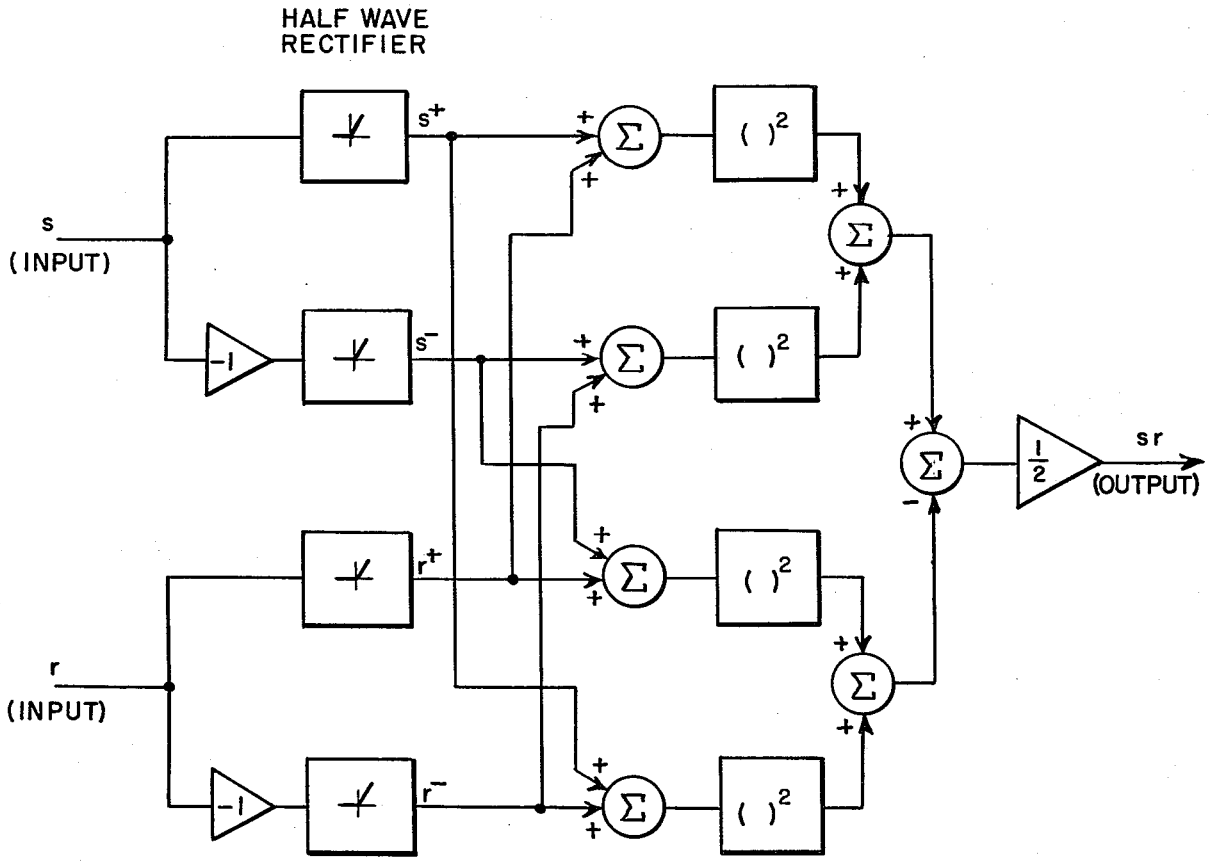
FIG. 2A. MULTIPLIER USING SQUARE-LAW DEVICES WITH NON-NEGATIVE INPUTS.
(FOR EXAMPLE, FET IN SQUARE-LAW MODE).

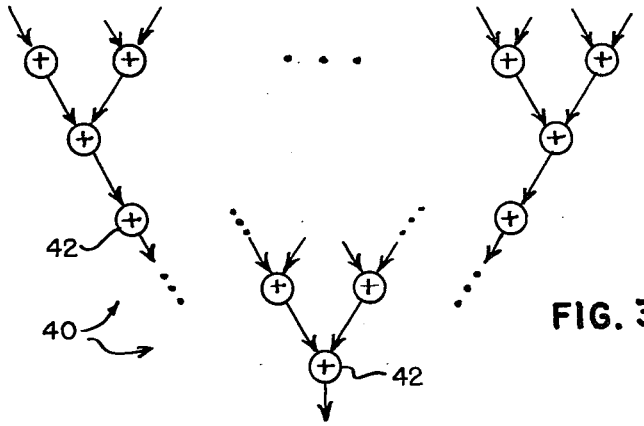
FIG. 3. CORPORATE ADDER ARRANGEMENT.
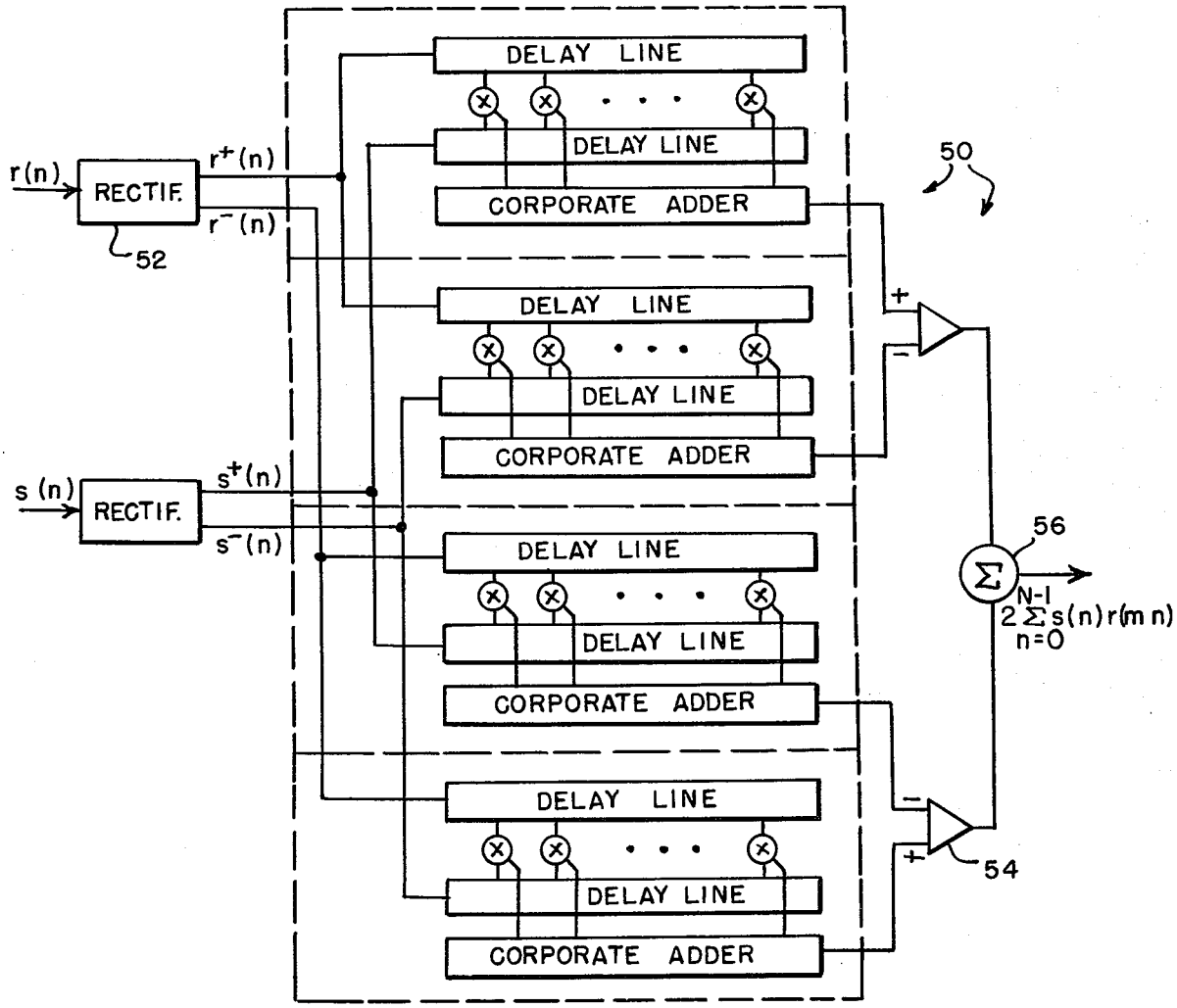
FIG. 4. CORRELATOR STRUCTURE, USING THE FILTERS OF FIG. I AS BASIC ELEMENTS.

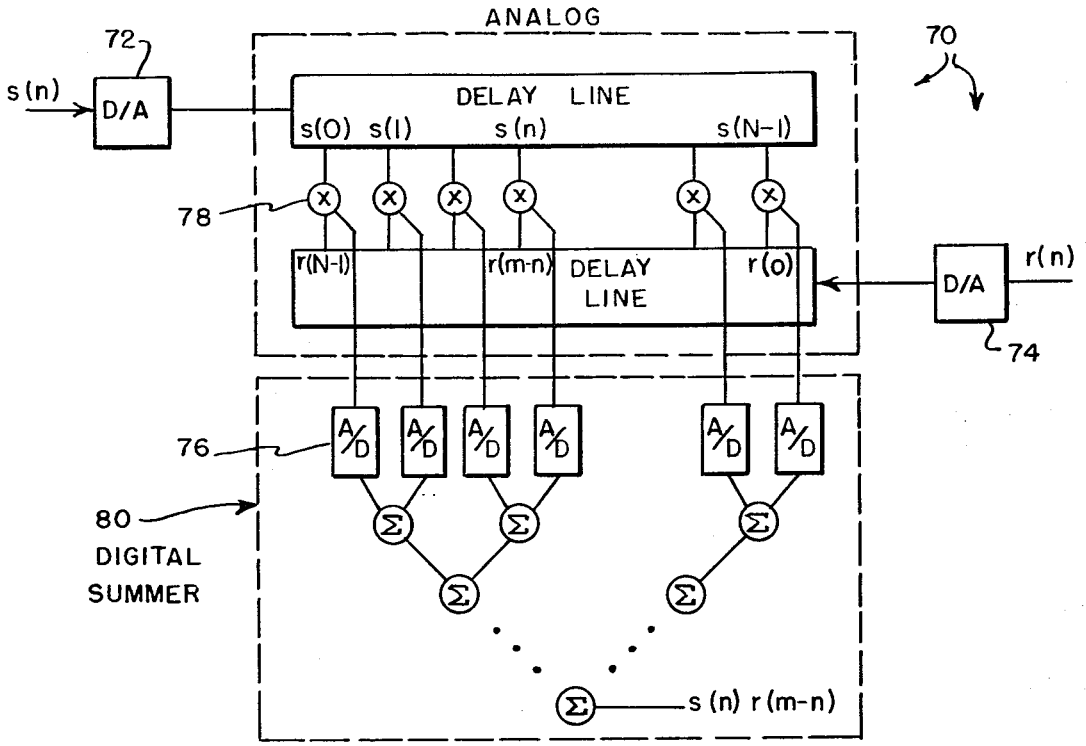
FIG. 5. DIGITAL CROSS-CORRELATOR.
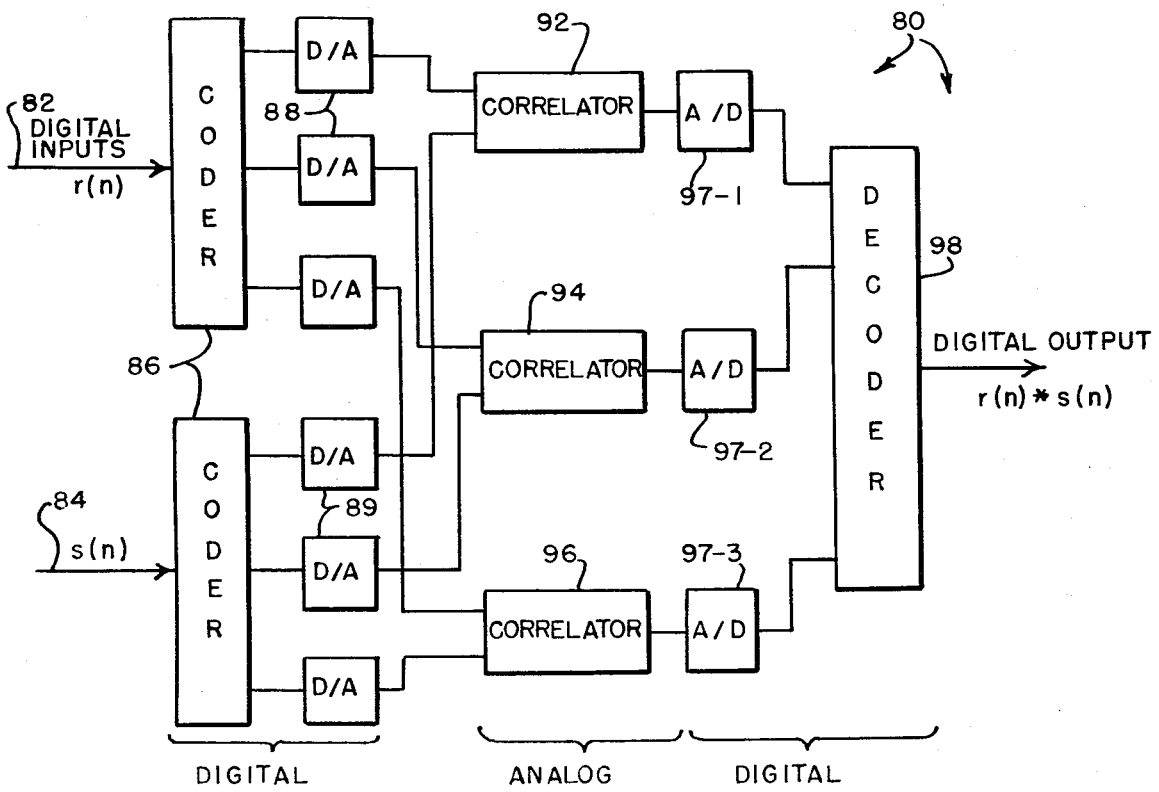
FIG. 6. PARALLEL ANALOG/DIGITAL ARCHITECTURE BASED ON RADIX ARITHMETIC.

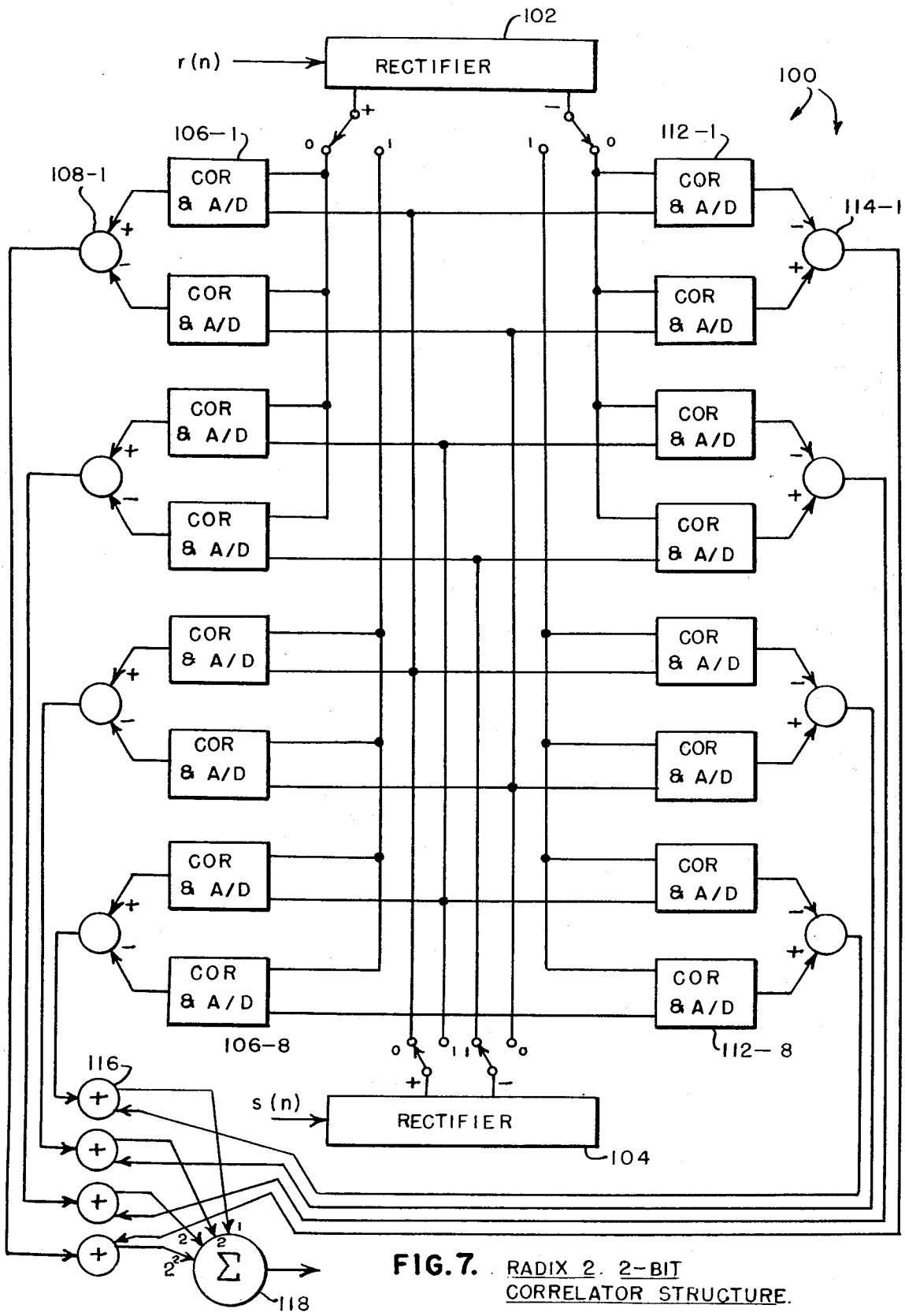
FIG. 7. RADIX 2. 2-BIT CORRELATOR STRUCTURE.

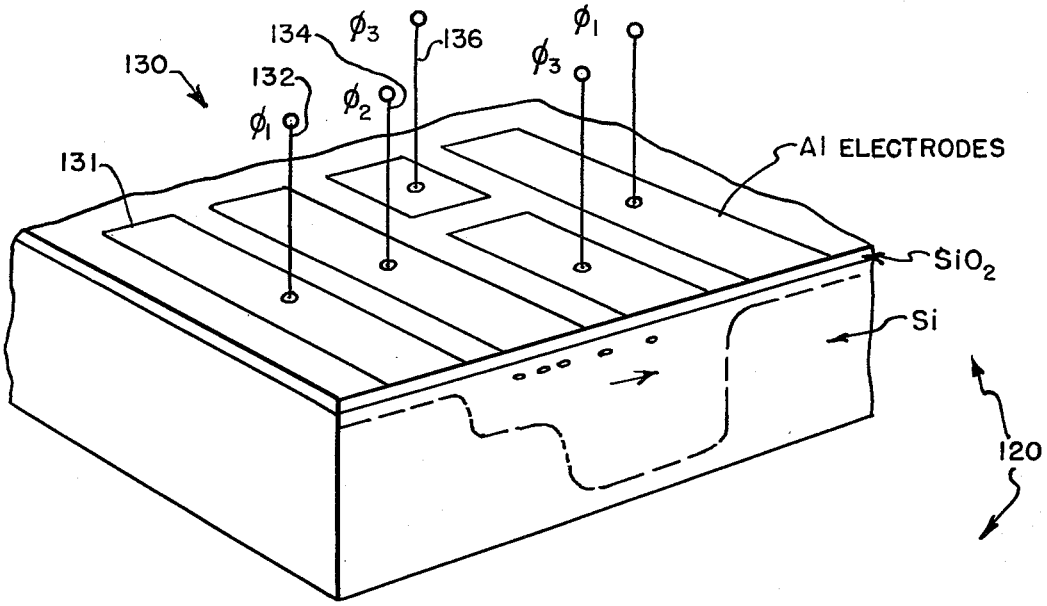
8A. CCD FILTER
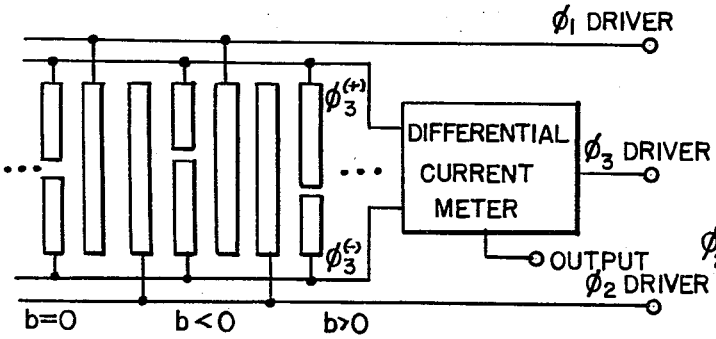
8B. CIRCUIT CONNECTIONS.
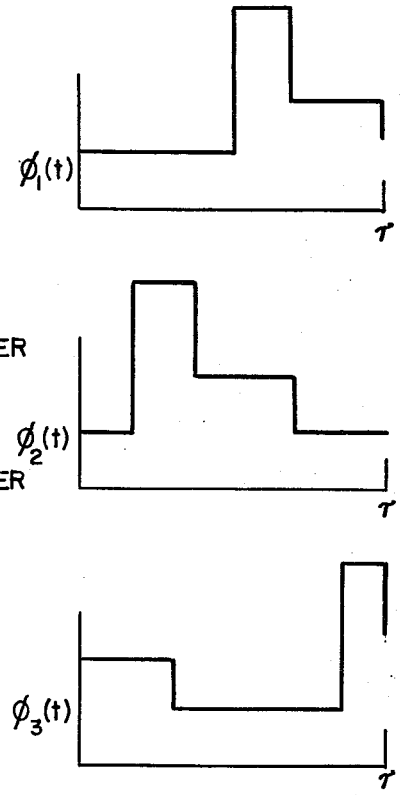
8C. CLOCK FUNCTION REQUIRED TO SHIFT INFORMATION FORWARD ONE BIT.
FIG. 8. (PRIOR ART)
CHARGE-COUPLED TRANSVERSAL FILTER.

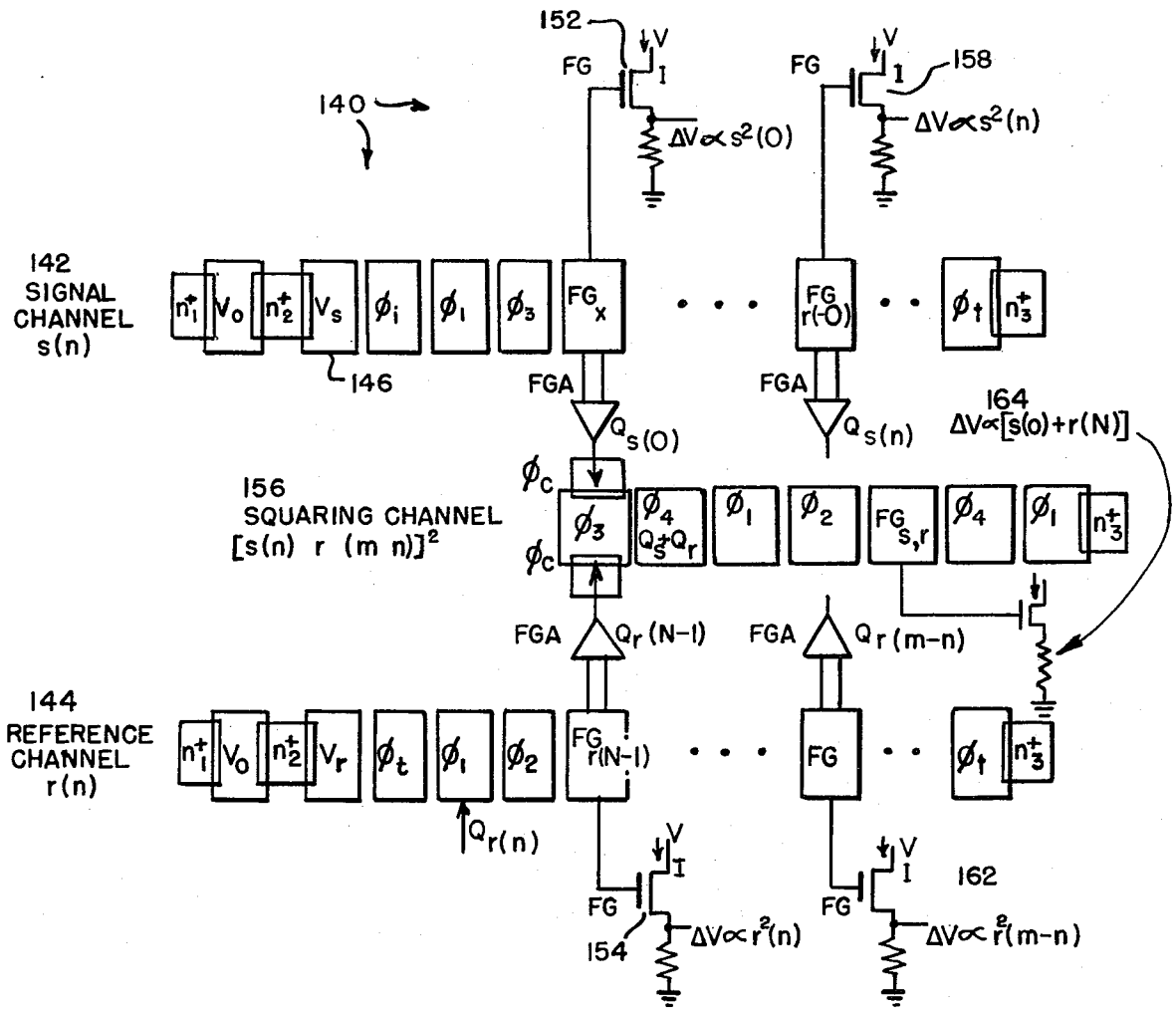
FIG. 9. DEVICE IMPLEMENTATION FOR ANALOG MULTIPLICATION OF s(n) AND r(m−n).

CCD ANALOG AND DIGITAL CORRELATORS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Analog and digital correlators herein described are suitable for use in signal processing applications such as sonar, radar, communication, frequency domain beamforming, and image transform apparatus.

The cross-correlator or cross-convolver is a powerful signal processing module for many sonar, radar, communication, beamforming, and image processing tasks which require linear filtering, convolution, cross-correlation, or Fourier transform calculation. For such tasks the cross-correlator has a high degree of computational parallelism and flexibility, with minimal control overhead.

The primary limitation of present analog cross-correlators is the attainable accuracy and the fact that a hybrid technology is generally required for their implementation. Representative examples are the surface acoustic wave (SAW) plate convolver and the SAW diode convolver. The plate convolver depends upon the nonlinear interaction between a pair of SAWs on a common piezoelectric substrate. Since the interaction is very weak, the device suffers from high insertion loss. The SAW diode correlator uses taps which are electrically coupled to diodes on a second substrate to provide the required mixing or multiplication. This presently requires a hybrid fabrication procedure and hence many separate electrical bonds, increasing the time required for fabrication and limiting the reliability of the device for military applications. Other state of the art analog correlators such as the optical correlators or bulk acoustic wave correlators are even less amenable to inexpensive planar large scale integrated (LSI) circuit fabrication.

Three types of digital cross-correlators are known in the prior art. In the first, a single multiplier and adder are used to accumulate the cross-correlation value. The speed of such a cross-correlator is much slower than that of the required multiplier and adder. In the second type of digital cross-correlators, Fast Fourier Transform (FFT) is used to compute the cross-correlation. If a single multiplier is used in the FFT, the number of multiplication times required is proportional to $N \log_2 N$, where N is the data block length, so once again the correlation speed is slow compared to the multiplier speed. Finally, LSI binary-versus-binary cross-correlators with analog summation have been built. The primary limitation of the latter correlators is their relatively high power dissipation, about 2.5 watts for a length 64 binary-versus-binary cross-correlation. A 10-bit versus 10-bit correlation of length 64 using such modules would require 250 watts and would preclude its use in many applications because of cooling as well as power requirements.

Some of the material herein disclosed has appeared in an article entitled "Improving the Accuracy of Analog Signal Processing Devices by Implementing Residue Class Arithmetic", by James W. Bond, which appeared in Journee's d' Electronique 1975, Advanced Signal Processing Technology.

SUMMARY OF THE INVENTION

A convolver comprises a first, multi-tap, delay line at one end of which, for example the left end, is applied a signal s(n), the signals at the outputs of the various taps, starting from the left end, being s(0), s(1), . . . , s(N−1). A second N-tap delay line, at the right end of which is applied a signal r(n), has as it outputs, from the right end of the line, the signals r(0), r(1), . . . , r(N−1). A plurality of N multipliers have two inputs, one input from each of the two delay lines, being paired as follows: the s(0)th tap of the first delay line and the r(N−1)th output of the second delay line being connected to the left most multiplier, the s(1)th output of the first delay line and the r(N−2)th output of the second delay line being connected to the second multiplier, etc. A means for adding adds the N outputs of the multipliers, the output of the adding means being the summation from n=0 to N−1 of the quantity s(n)r(m−n). The first and second delay lines, the multipliers and the means for adding are implemented as charge-coupled devices.

OBJECTS OF THE INVENTION

An object of the invention is to provide a correlator/-convolver which can be implemented on charge-coupled devices (CCDs).

Another object of the invention is to provide a convolver/correlator structure which uses a simpler convolver/correlator as a module.

Yet another object of the invention is to provide such a correlator/convolver structure which uses radix arithmetic.

Still another object of the invention is to provide such a correlator/convolver structure which is implemented using residue arithmetic.

BRIEF DESCRIPTION OF THE DRAWINGS

FIG. 1 is a block diagram of an analog convolver/-programmable filter.

FIG. 2 comprises FIGS. 2A and 2B, both showing block diagrams of multiplier operation performed by a squaring device and a differential amplifier.

FIG. 3 is a block diagram of a corporate adder arrangement.

FIG. 4 is a block diagram of a correlator structure, using the convolvers of FIG. 1 as basic elements.

FIG. 5 is a block diagram showing the convolver of FIG. 1, with added elements for digital operation.

FIG. 6 is a block diagram of a parallel analog/digital architecture, based on radix arithmetic.

FIG. 7 is a block diagram of a correlator structure for radix-two two-bit operation.

FIG. 8 comprises three parts involving charge-coupled transversal filters:

FIG. 8A showing a CCD filter;

FIG. 8B showing the circuit connections; and

FIG. 8C showing the clock function required to shift information forward one bit.

FIG. 9 is a partially block and partially schematic diagram showing CCD implementation for analog multiplication of s(n) and r(m−n).

DESCRIPTION OF THE PREFERRED EMBODIMENTS

The herein described invention comprises at least two parts: an analog correlator using the square law characteristics of MOSFET transistors in the saturation region, together with charge-coupled device (CCD) delay lines, and a number of digital correlator structures using a combination of analog correlation, analog-to-digital conversion, and digital combining.

Analog Convolution Using CCDs

The conceptual structure of a crossconvolver is reviewed in FIG. 1A. A crosscorrelator would differ only in that signals would shift in the same direction. This figure may describe a variety of different crosscorrelators, depending upon (a) the format of the input signals r and s, (b) the type of delay lines, (c) the type of multipliers, and (d) the method of summation used to form the final output.

There is an extensive literature in the prior art describing the use of charge coupled devices as analog delay lines. The main problems in the design of an analog CCD correlator are the design of the multiplier—especially handling both positive and negative quantities—and the design of the adder which sums the products of the multipliers.

A MOSFET transistor has a very high gate impedance and may thus be used to nondestructively sense the charge in a given cell of a CCD. If the transistor is operated in the saturation region, its drain current is a quadratic function of the gate-to-source voltage, and such quadratic functions can be combined to form a multiplier, using the identities of Equations (1) or (2).

$$xy=\tfrac{1}{4}[(x+y)^2-(x-y)^2] \tag{1}$$

$$xy=\tfrac{1}{2}[(x+y)^2-x^2-y^2] \tag{2}$$

Two difficulties are associated with trying to use either Eqn. (1) or Eqn. (2) directly in an analog CCD/MOSFET correlator: the signals may be either positive or negative at each sample point, and it is difficult to implement high speed differential amplifiers on the same LSI substrate as a CCD.

For this reason, an identity is used which decomposes signals into their positive and negative parts. The decomposition into positive and negative parts is shown in Equations (3)-(5)

$$s^+ = \begin{cases} s, & s \geqq 0 \\ 0, & s < 0 \end{cases} \tag{3}$$

$$s^- = \begin{cases} 0, & s \geqq 0 \\ -s, & s < 0 \end{cases} \tag{4}$$

$$s=s^+ - s^- \tag{5}$$

It will be noted from Eqs. (3) and (4) that $s^+$ and $s^-$ are never negative, regardless of the sign of s.

Similar relations are applicable to a signal r.

Equation (6) is an identity for multiplication in terms of the positive and negative parts of the two signals, s and r:

$$sr=\tfrac{1}{2}[(s^+ + r^+)^2+(s^- + r^-)^2]-[(s^+ + r^-)^2+(s^- + r^+)^2] \tag{6}$$

A multiplier using Eq. (6) is shown in FIG. 2A.

If this identity is used in a convolver, the terms in the sum of products may be regrouped as shown in Eq. (7) so as to require only a single subtractor or differential amplifier 38.

$$\sum_{n=0}^{N-1} s(n)r(m-n) = \tfrac{1}{2}\sum_{n=0}^{N-1}(s^+(n)+r^+(m-n))^2 + \sum_{n=0}^{N-1}(s^-(n)+r^-(n-m))^2 - \sum_{n=0}^{N-1}(s^+(n)+r^-(m-n))^2 + \sum_{n=0}^{N-1}(s^-(n)+r^+(m-n))^2 \tag{7}$$

The corresponding correlator 30 structure is shown in FIG. 2B.

It will be noted that the basic module which performs almost all of the computational work forms a sum of squares of the pairwise sums of two non-negative sequences, so that each module only has to accept inputs all of the same sign. The required summations may be performed by transferring charges to a common summing capacitor. Since it is difficult to transfer charges into a given capacitor on a CCD from more than about four directions at once, the large sum will generally be performed via a corporate feed adder 40 as shown in FIG. 3.

FIG. 4 shows a correlator 50 having these basic components.

Hybrid Analog/Digital Convolution

The analog convolver 10 of FIG. 1 may be turned into a digital convolver 70, shown in FIG. 5, by adding digital-to-analog (D/A) converters, 72 and 74, to the inputs, adding analog-to-digital converters 76 to the multiplier 78 outputs, and replacing the analog summer, 18 of FIG. 1, by a digital summer 80, as shown in FIG. 5. Alternatively, several of the product terms may be summed in analog form prior to A/D conversion and digital summation in order to reduce the number of A/D converters and digital adders required. In either case it is essential that the range of input integers not be too large, in order to prevent the (approximate) analog operations from giving the wrong answer when converted to digital forms; i.e. the analog error allowable is equal to one half of the amplitude resolution of the A/D converters. Since it is difficult to perform analog operations with an accuracy much better than 1%, this will place a limit on how large the sum of products may be in such a module. If it is desired to perform a long convolution with large dynamic range, it will be necessary to combine several such modules. The next section discusses one method of combining low dynamic range digital correlator or convolver modules to perform a computation with greater dynamic range.

Digital Correlation Using Radix Arithmetic

First the convolution of two non-negative sequences of integers s(n) and r(n) will be considered, where the first sequence has a radix $R_1$ representation and the second sequence has a radix $R_2$ representation. The number of digits used in the two representations are $D_1$ and $D_2$, respectively. The radix would be 2 for binary arithmetic, 10 for decimal, etc.

$$s(n) = \sum_{u=0}^{D_1-1} s_u(n)\, R_1^{\,u} \tag{8}$$

$$r(n) = \sum_{t=0}^{D_2-1} r_t(n)\, R_2^{\,t} \tag{9}$$

It will be noted that the digits in the first sequence, represented by Eq. (8), range from 0 to $R_1-1$, and the numbers represented range from 0 to $R_1^{D1}-1$. Similarly, in the second sequence of Eq. (9) the digits range from 0 to $R_2-1$, and the numbers represented range from 0 to $R_2^{D2}-1$. The convolution sum is shown in Eq. (10) in terms of the radix representations.

$$\sum_{n=0}^{N-1} s(n)\, r(m-n) = \sum_{u=0}^{D_1-1} \sum_{t=0}^{D_2-1} \left[ \sum_{n=0}^{N-1} s_u(n)\, r_t(n-m) \right] R_1^u R_2^t \tag{10}$$

The left hand side of the above equation represents the desired cross convolution.

Each term inside the brackets is a cross correlation, or a cross convolution. It will be noticed that there is one such cross correlation for each value of u and t so that there are $D_1$ values of u and $D_2$ values of t. Each of the cross convolutions are implemented with separate cross convolvers, a total of $D_1D_2$ cross convolvers. The outputs of the convolvers are weighted, as shown in the right hand side of the equation and then they are summed up in the outer summations. The inner summation represents the individual convolver.

The right hand side may be implemented using $D_1D_2$ cross convolvers of length N, each of which convolves an $R_1$-level sequence with an $R_2$-level sequence. The most useful cases are when $R_1$ is a power of $R_2$ or when either $D_1$ or $D_2$ is one. In either of these cases the final weighted summation may be performed by using only positional shifts and adds.

In order to accept signals which have negative as well as positive samples, the signals may be first decomposed into positive and negative parts, as in equations (3)–(5), and then the positive and negative parts may be represented in radix notation as in Eq. (8).

$$s^+(n) = \sum_{u=0}^{D_1-1} s_u^+(n)\, R_1^u \tag{11}$$

$$s^-(n) = \sum_{u=0}^{D_1-1} s_u^-(n)\, R_1^u \tag{12}$$

A similar pair of relations may be derived for $r^+(n)$ and $s^-(n)$.

$$s(n)\, r(m) = [s^+(n)-s^-(n)][r^+(m)-r^-(m)] = [s^+(n)r^+(m)+s^-(n)r^-(m)]-s^+(n)r^-(m)+s^-(n)r^-(m)] \tag{13}$$

Equation (13) represents a general four-quadrant multiplication in terms of one-quadrant (non-negative only) multipliers, adders, rectifiers, and a single subtractor. It is easily extended to a convolution as shown in Eq. (14). Eq. (14) shows how to perform a convolution of two arbitrary sequences using convolvers which accept only non-negative inputs.

$$\sum_{n=0}^{N-1} s(n)\, r(m-n) = \left[ \sum_{n=0}^{N-1} s^+(n)\, r^+(m-n) + \sum_{n=0}^{N-1} s^-(n)\, r^-(m-n) \right] - \left[ \sum_{n=0}^{N-1} s^+(n)\, r^-(m-n) + \sum_{n=0}^{N-1} s^-(n)\, r^+(m-n) \right] \tag{14}$$

If the radix representations of the positive and negative parts of the two signals are substituted into equation (14), then a method is obtained for performing the cross-convolution of signed signals with high dynamic range, using convolvers which accept only non-negative signals of low dynamic range as shown in equation (15).

$$\sum_{n=0}^{N-1} s(n)\, r(m-n) = \sum_{u=0}^{D_1-1} \sum_{t=0}^{D_2-1} \left\{ \left[ \sum_{n=0}^{N-1} s_u^+(n)\, r_t^-(m-n) + \sum_{n=0}^{N-1} s_u^-(n)\, r_t^-(m-n) \right] - \left[ \sum_{n=0}^{N-1} s_u^+(n)\, r_t^+(m-n) + \sum_{n=0}^{N-1} s_u^-(n)\, r_t^+(m-n) \right] \right\} R_1^u R_2^t \tag{15}$$

Digital Correlation Using Residue Class Arithmetic

Let M be a positive integer and x be an integer. Then x can always be represented in terms of its quotient and least positive remainder upon division by M, as shown in Eq. (16):

$$x = qM + r,\ 0 \leqq r \leqq M-1 \tag{16}$$

All of the integers x, x±M, x±2M, x±3M, have the same least positive remainder, and are said to belong to the same residue class modulo M. There are exactly M distinct residue classes modulo M; the residue classes of 0,1, . . . M−1. In the arithmetic of residue classes modulo M, essentially ordinary addition and multiplication is performed, but attention is paid only to the residue class to which the result belongs, i.e. multiples of M are ignored.

Residue arithmetic was studied extensively by K. F. Gauss, Disquitiones Arithmetice, translated from Latin to English by Arthur J. Clarke, New Haven, Yale University Press, 1966. In recent years it has been applied to the construction of error correcting codes by Peterson, W. W. and E. J. Weldon, Jr. *Error Correcting Codes,* second edition MIT Press, Cambridge, Mass. 1972.

It has been studied extensively for use in general purpose digital computers because it offers the possibility of relatively simple adders and multipliers, since no carry terms are needed when performing those operations in a multiple residue representation. However, in such general applications, overflow detection and division present formidable difficulties, and hence it has not been extensively used in practice. An excellent book has been written to collect this material in one place. It is authored by S. S. Szabo and N. I. Tanaka and is entitled "Residue Arithmetic and its Applications to Computer Technology," and published by McGraw-Hill Book Company, 1967. Another useful reference is H. L. Garner, The Residue Number System, I.R.E. Transactions on Electronic Computers, pp. 140–147, June 1959. Other references will be mentioned where applicable.

Cheney has pointed out that correlation requires only multiplications and additions—operations which are easily performed with residue arithmetic. However, his correlator used only a single multiplier and adder, and hence was relatively slow.

In ordinary binary addition and subtraction, if the answer is scaled down so as to avoid overflow, then roundoff or truncation errors must be overcome. Residue arithmetic has no truncation errors. If residue arithmetic is substituted for ordinary arithmetic either the exact answer is obtained, or the answer is off by a multiple of M, i.e. only "large" errors are made, not small ones, so that if there is sufficient information to avoid large errors, then the computation is exact.

If $$M = M_1 M_2 \ldots M_T \tag{17A}$$

where no two of $M_i$'s have a common divisor greater than 1, then the least nonnegative residue of x modulo M is uniquely determined by the least nonnegative residues modulo $M_1$, $M_2$, etc. Let r denote the least nonnegative residue of x modulo M, and $r_i$ denote the least nonnegative residue modulo $M_i$. Converting from r to $(r_1, r_2, \ldots, r_T)$ is straightforward: $r_i$ is the remainder of r after dividing by $M_i$.

Example: Let $M=6$, $M_1=2$, $M_2=3$.

TABLE 1

| | of Least Non-negative Residues | |
|---|---|---|
| r | $r_1$ | $r_2$ |
| 0 | 0 | 0 |
| 1 | 1 | 1 |
| 2 | 0 | 2 |
| 3 | 1 | 0 |
| 4 | 0 | 1 |
| 5 | 1 | 2 |

Converting from $(r_1, r_2, \ldots, r_T)$ may be either simple or complicated, depending upon the choice of the individual moduli, $M_1$, $M_2$, . . . $M_T$.

The correlation of sequences of integers modulo m for m some integer greater than one, will now be considered. The approach here is to calculate the correlation sum up to the nearest multiple of m. In order to minimize the dynamic range required of the device performing the correlation the sequences {A(n)} and {B(n)} are reduced modulo m to integers between 0 and m−1, i.e. each A(n) and B(n) is replaced by its remainder after division by m. These reduced sequences consisting of only non-negative integers are denoted by $[A(n)]_m$, $[B(n)]_m$. It will be observed that not only does $[B(n)]_m$ consist entirely of non-negative integers but so does $[-B(n)]_m$. Thus the quarter square identity in residue arithmetic modulo m, using Eq. (1), $$[A(n)]_m[B(n+r)]_m = \tfrac{1}{4}([A(n)]_m + [B(n+)]_m)^2 - ([A(n)]_m + [-B(n+k)]_m)^2 \tag{17B}$$

can be made the basis for a correlator structure utilizing CCD 1-quadrant square-law devices whenever m is an odd integer. If m is even, $(\frac{1}{4})[A]_m$ for an integer A is not defined because there is no integer modulo m which corresponds to division by 4. By noting Eq. (17), it can be seen that the correlation is given by $$\sum_{R=0}^{N-1} A(n)\, B(n+k)_m = \frac{1}{4} \sum_{h=0}^{N-1} [A(n)_m + [B(n+k)]_m^2 - \sum_{n=0}^{N-1} [A(n]_m + [-B(n+k)]_m^2 \tag{18}$$

It is also possible to combine the radix approach with the residue approach. In this case each of the integers $A_u(n)$ and $B_v(n)$ are reduced modulo m to obtain $[A_u(n)]_m$ and $[B_v(n)]_m$, so that Eq. (18) becomes $$\left[\sum_{n=0}^{N-1} A(n)\, B(n+k)\right]_m \tag{19}$$

-continued $$\sum_{s=0}^{N-1} \sum_{n=0}^{N-1} \sum_{k=0}^{N-1} [A_u(n)]_m [B_v(n+k)]_m R^u R^v$$

The inner sum can then be calculated using the square-law identity as in the residue class case discussed hereinabove. The reasons for using a combination of residue arithmetic and radix arithmetic would be to reduce the required range of input values from 0 to m−1 to 0 to R−1. This may become necessary if it is desired to use a number of odd modulo m which are relatively prime. Because there are available only a limited number of small odd relatively prime moduli, one is forced to have one or more moduli larger than a typical analog device can handle directly.

If the left hand sum (19) has been calculated up to the nearest multiple of a modulus $m_1$, modulus $m_2$ . . . , modulo $m_t$, then its value can be determined up to the nearest multiple of $m_1 m_2 \ldots m_t$, provided that no two of the modulo $m_1, m_2, \ldots, m_t$ have a positive integer factor in common greater than one. Thus by using correlators in parallel which determine the correlation sums to 1 part in $m_i$, it is possible to determine the product to 1 part in $m_1 m_2 \ldots m_t$.

The calculation of $[A]m_1 m_2 \ldots m_t$ from $[A_1]_{m1}$, $[A_2]_{m2}$, . . . , $[A_t]m_t$ such that $$[A]_{mi} = [A_i]_{mi} \tag{20A}$$

is based on the well-known Chinese Remainder Theorem. These calculations would be done in the digital domain and are described in the reference to Szabo & Tanaka, pp 27, 28 and 29.

Cross-Correlators Based on Square Law-Identities (A) Analog: An analog cross-correlator 10 easily implemented in CCD technology is illustrated in FIG. 1. In this diagram the convolution/correlation of two discrete signals s and r can be expressed as $$(s * r)(A_n) = \sum_{n=0}^{N-1} s_n r_{m-n} \text{ (convolution)} \tag{20B}$$

is seen as the formation of the sum of products of the shifted sequence $s_n$ with the reversal of the sequence $r_n$. For compact, low power, implementation of this programmable transversal filter or cross-correlator structure, the action of two CCD delay lines, 12 and 14, shifting and storing the signal [s(n)] and reference [r(n)] samples is combined with the non-destructive sensing and tapping circuitry feeding into the analog multipliers 16.

The timing is simple when $N=2^n$. For then the corporate adder consists of $1+2+2^2+\ldots+2^{P-1}$ adders as illustrated in FIG. 3. Assuming that there are N number of taps 17, one for each multiplier 16, and that there are $2^P$ summers in the top row of the corporate adder 40 shown in FIG. 3, then in the next row there would be $\frac{1}{2}(2^P)$. But this is the same as $2^{P-1}$. Assume N=the no. of taps $=2(2^P)=2^{P+1}$. (21) If one starts counting at the bottom, where there is only one summer 42, then two at the next, etc., up to the final number of summers, which is half the number of taps. Then, $$S = 1 + 2 + 4 + \ldots + 2P. \tag{22}$$

Using the rules of geometrical progression, therefore, the required number of summers $=2^{P+1}-1$. But, $$2(2^P)=\text{the total number of taps}=N=2^{P+1}. \quad (23)$$

Therefore, if there are 32 taps, 31 summes would be required.

Each multiplier 16 in FIG. 1 is illustrated in FIG. 2. Multiplication is accomplished by adding sample s(n), 32, to sample s(m−n), 34, squaring the sum, in squarer 36, and calculating twice the product by subtracting the sum of $s(n)^2$ and $s(m-n)^2$ in differencer 38. This multiplier 31 structure is natural to implement by CCD technology because charge can be summed by moving a charge proportional to r(n) and r(m−n) into a common well, and can be squared by a sensing this charge by a floating gate charge amplified operated in the saturation region. However, the device 10 illustrated in FIG. 1 requires N differential amplifiers, 38 in FIG. 2, to perform the required differences $(r(n)+s(n-m)^2-(r(n)^2+s(n-m)^2)$. Furthermore CCD's can only manipulate non-negative quantities of charge. These facts led to the device 50 illustrated in FIG. 4.

A rectifier 52 is used to express r(n) and s(n) in terms of non-negative sequences:

$$r(n)=r^{30}(n)-r^{-}(n) \quad (24)$$

$$s(n)=s^{+}(n)-s^{-}(n) \quad (25)$$

with $$r^{+}(n),\ r^{-}(n),\ s^{+}(n),\ \text{and}\ s^{-}(n)$$

characterized mathematically by requiring $$r^{+}(n),\ r^{-}(n),\ s^{+}(n),\ s^{-}(n)\geqq 0 \quad (26)$$

and $$r^{+}(n)r^{-}(n)=0,\ s^{+}(n)s^{-}(n)=0 \quad (27)$$

Four correlator devices similar to the one, 10, illustrated in FIG. 1 (except that differential amplifiers, 38 in FIG. 2, are not used at each multiplier 16, as illustrated in FIG. 4) are used to calculate the sums:

$$\sum_{n=0}^{N-1}(s^{+}(n)+r^{+}(m-n))^2\ \sum_{n=0}^{N-1}(s^{+}(n)+r^{-}(m-n))^2 \quad (28)$$

$$\sum_{n=0}^{N-1}(s^{-}(n)+r^{-}(m-n))^2,\ \text{and}\ \sum_{n=0}^{14-1}(s^{-}(n)+r^{+}(m-n))^2 \quad (29)$$

which combined as illustrated in FIG. 4, yields $$2\sum_{n=0}^{N-1}s(n)\,r(m-n). \quad (30)$$

It may be noted that four devices 10 illustrated in FIG. 1 along with rectifier circuits 52 in FIG. 4, and the 2 differential amplifier 54 and 1 adder 56 would also be necessary to provide 4-quadrant correlation, so that the correlator 50 illustrated in FIG. 4 represents a simplification in hardware to accomplish correlation over the one, 10, illustrated in FIG. 1 in this case.

FIG. 8 shows the basic circuitry and wave forms 120 for a charge-coupled filter 130, connections of the required driver voltages $\phi_1$, $\phi_2$ and $\phi_3$ to the conductive elements 131 of the filter 130 being shown by numerals 132, 134 and 136 in FIG. 8A. The circuit connections of the driver voltages are more precisely defined in FIG. 8B. FIG. 8C shows the temporal relationships of the voltages $\phi_1(t)$, $\phi_2(t)$ and $\phi_3(t)$.

FIG. 8 provides useful background information for the embodiment 140 of FIG. 9.

FIG. 9 shows an implementation 140 which illustrates the techniques for: (1) injecting charges in channels 142 and 144, by means of voltages $V_s$, labelled 146, and $V_r$, 148, which are proportional to the voltage sequences s(n) and r(m−n), (2) non-destructively sensing and tapping each sample s(n) and r(n), by means of floating gate MOSFETS 152 and 154; (3) forming the summation s(n)+r(m−n), in channel 156; and (4) finally for squaring s(n), r(m−n), and [s(n)+r(n)] in simple, floating gate amplifiers, in amplifiers 158, 162 and 164; these MOSFET amplifiers operating in the saturation region having outputs proportional to $s^2(n)$, $r^2(m-n)$, and $[s(n)+r(m-n)]^2$ then could be fed into a differential amplifier, not shown, to produce s(n)r(m−n) from the identity:

$$s(n)r(m-n)=\tfrac{1}{2}[s(n)+r(n)]^2-[s(n)^2+r(m-n)^2] \quad (31)$$

The performance of the basic operations (1), (2), (3), and (4) above is the basis for real-time convolution of signals. The functions (3) and (4) are performed in what is labelled "multiplier", 17 and 31, in the block diagrams of FIGS. 1 or 2. A one-quadrant multiplier (i.e., both s(n) and r(n) are positive quantities) or a one-cell cross convolver has been constructed using CCD technology. A 32-sample programmable filter would simply consist of 32 serial juxtapositions of such cells.

The corporate adder could be implemented using the same techniques as those described for adding s(n) and r(n−m), using CCD technology.

The structure inside the dotted lines in FIG. 5 can also be made the basic module for digital correlations, which will be described next.

Digital Correlators

The analog correlator 140 described in the previous section, in connection with the CCD embodiment 140 shown in FIG. 9, and first shown very simply in FIG. 1, can be viewed as a digital component when used in a structure 70 illustrated in FIG. 5. The complete correlation, 80 in FIG. 6, utilizes the structure illustrated in FIG. 5 in parallel. FIG. 6 illustrates the overall architecture when three correlators are used.

These are two fundamental approaches to utilizing analog correlators as digital components, one is based on radix arithmetic and the other is based on residue arithmetic. The one based on radix arithmetic is simplest to describe and will be described first. In every case the corporate adder can be either wholly analog, wholly digital, or partly analog followed by A/D converters and the remainder digital.

Digital Correlator Based on Radix Arithmetic

Suppose that the digital inputs, 82 and 84, in FIG. 6 are expressed in binary notation. Then the simplest radix R correlator, 92, 94 or 96, to described is for R=2. In this case the coders, 82 or 84, would simply route the positive and negative unit bits to two of the fixed correlators 92, 94 or 96, the positive and negative to two other fixed correlator, etc. There would be one set of correlators for each combination of signs of the two inputs, 82 and 84. The D/A and A/D converters, 88 and 97, would just interface the digital and analog components, 82 and 84 to 92, 94 and 96. The decoder 98 would consist of multiplication by a power of 2 and adding the digital outputs.

An example of such a correlator structure will now be described. Suppose a and b are 2-bit words with a sign bit set.

$$a_+ = a \text{ if } a \geqq 0$$

$$a_- = -a \text{ if } a < 0$$

$$b_+ = b \text{ if } b \geqq 0$$

$$b_- = -b \text{ if } b < 0 \qquad (32)$$

Then $$a_+ = (a_{+0}, a_{+1})$$

$$a_- = (a_{-0}, a_{-1})$$

$$b_+ = (b_{+0}, b_{+1})$$

$$b_- = (b_{-0}, b_{-1}) \qquad (33)$$

There are four correlators for each combination of signs.

Let us assume that the corporate adder, 40, in FIG. 3, is actually analog.

Then the resulting structure requires a single A/D converter for each correlator. In FIG. 7 the outputs of the circuits 116 represent the digital output. The numbers above the lines into the final summer 118 denote the number of fixed multipliers required for decoding.

It is obvious that using the correlators 106 and 112 as binary correlators requires a great many correlator structures. To correlate two 5-bit data inputs it would be necessary to use 100 correlators. To overcome this difficulty radices other than 2 can be used. Powers of 2 are well suited. Indeed consider $2^3$. then a binary "a" can readily be interpreted base 8, indeed $$a_0 + 2a_1 + 2^2a_2 + \ldots + 2^8a8 = (a_0 + 2a_1 + 2^2a_2) + [2a_3 + 2a_4 + 2^2a_5) + 2^6(a_6 + 2a_7 + 2^2a_8) \qquad (34)$$

Therefore, it follows that coding a binary word radix 8 only requires grouping the binary digits in threes. Each triplet would go into a D/A converter which would generate an output proportional to its numerical value. The output D/A and the rest of the structure could remain unchanged. The same structure 100 as illustrated in FIG. 7 would suffice except now the inputs to the correlator would consist of 8-level signals instead of 2-level signals and the rectifiers 102 and 104 would include more complicated D/A converters. The same number of correlators now would process 6-bit inputs rather than 2-bit inputs.

Digital Correlators Based on Residue Arithmetic

Digital correlator structures can be based on residue arithmetic instead of radix arithmetic. The coder 86 in FIG. 6 now reduces the input data sequences, 82 and 84, in a modulo manner and according to the different moduli used. The correlators 92, 94 and 96, can now be viewed as residue arithmetic components. The decoder 98 consists of fixed multipliers and summers structured to implement the Chinese Remainder Theorem. These structures are appealing because the use of residue arithmetic does not require carries and hence lends itself to parallel calculations. The basic structures will be illustrated by providing a detailed description of three examples of the proposed structures.

EXAMPLE 1

$m_1 = 5$, $m_2 = 7$

Since $m_1 m_2 = 35$, just a little more than $32 = 2^5$, it may be assumed that the input data is 6-bits. The calculations modulo $m_1$ and $m_2$ once reduced require 3-bits. The required coding and decoding could be based on ROMS (read-only memories). The structures presented in FIG. 8 illustrate an alternative, and simpler approach, which is based on the previous section describing coding.

EXAMPLE 2

$m_1 = 5$, $m_2 = 7$, $m_3 = 13$.

If the output of the structure described in Example 1 did not provide high enough accuracy (1 part in 35) then calculations in a third relatively prime modulus could be done. A coder for the modulus 13 would then be another correlator structure associated with the required modulus 13, and a more complicated decoder.

This structure would have an architecture 80 illustrated in FIG. 6, with the top correlator 92 associated with modulus 5, the middle one, 94, with modulus 7, and the bottom one, 96, with modulus 13. The input to the top three D/A convertors 88 from top to bottom would be r(n) modulo 5, 7, and 13 respectively and, the bottom three D/A convertors 89, from top to bottom s(n) modulo 5, 7, and 13 respectively. The outputs of the converter 97-1 would be an integer between 0 and 4 expressed in binary notation, the middle converter 97-2 an integer between 0 and 6 expressed in binary notation, and the bottom A/D converter 97-3 an integer between 0 and 12 expressed in binary notation. The decoder 98 would consist of shifters and adders to implement the decoding equation developed hereinabove.

EXAMPLE 3

$m_1 = 5$, $m_2 = 7$, $m_3 = 13$ with one input of the correlator associated with residue class calculations modulo 13 based on Radix 4 notation. (Observe that the product of two integers in the correlator associated with modulus 7 could be as large as 36, while in the one associated with modulus 13 the product could be as large as 144. However, if one input is expressed in radix 4 the largest product necessary in either of the two correlators which would then be associated with modulus 13 would be $(3)(12) = 36$. Thus using a radix arithmetic for some of the inputs to the correlators can reduce the accuracy requirements of those associated with the largest moduli to levels comparable with smaller moduli.

Coding

The conceptual basis for coding of the input data for residue arithmetic will now be briefly described. The simplest case is the binary case. Suppose $$a = \sum_{i=0}^{n} a_i 2^i$$

is to be reduced modulo m with $$m = \sum_{i=0}^{r} m_i 2^i,\ m_2 = 1.\ \text{If } n \geqq r \tag{35}$$

then substitution of $$-\sum_{i=0}^{r-1} m_i 2^i$$

for $2^r$ (which it is congruent to modulo m) in the higher order terms of a reduces a to less than n+1 bits: If m has a very simple expression (1), then the reduction can be very simple. The procedures will be illustrated by example.

If m=5 then $2^2 \equiv -1$ mod 5 so that $$\begin{aligned} a &= \sum_{i=0}^{n} a_{2i} 2^{2i} + \sum_{i=0}^{n} a_{2i+1}(2^{2i+1}) \\ &\equiv \sum_{i=0}^{n} a_{2i}(-1)^i + \sum_{i=0}^{n} 2a_{2i+1}((-1)^i) \bmod 5 \end{aligned} \tag{36}$$

In particular, if n=2, Eq. (36) becomes $$a \equiv (a_o - a_2 + a_4) + (a_1 - a_3 + a_5) \tag{37}$$

which can be at most 6.

$$\text{If } a_1 - a_3 + a_5 = 2 \tag{38}$$

then $$a = (a_o a_2 + a_4) - 1 \tag{39}$$

which is less than 5, and if $$a_1 - a_3 + a_5 = 0 \text{ or } 1 \tag{39}$$

then Eq. (37) is already less than 5. A is negative, then −a must be checked. In applications, it might suffice to neglect testing for a ≧5 and only check that a is non-negative. If $m = 2^3 - 1$ and $2^3 \equiv 1$ mod 7 so that $$\begin{aligned} a &= \sum_{i=0}^{n} (a_{3i} 2^{3i} + a_{3i+1} 2\ 2^{3i} + a_{3i+2} 4.2^{3i}) \\ &\equiv \sum_{i=0}^{n} (a_{3i} + 2\ a_{3i+1} + 2a_{3i+2}) \end{aligned} \tag{40}$$

If n=1, Eq. (40) becomes $$a \equiv (a_o + a_3) + 2(a_1 + a_4) + 2^2(a_2 + a_5). \tag{41}$$

$$\text{Thus } 0 \leqq a \leqq 14 \tag{42}$$

If the $2^3$ term is reduced to 1 then this expression would be less than or equal to 7. If $m = 2^4 - 2 - 1 = 13$ then $$\begin{aligned} a &= \sum_{i=0}^{n} (a_{4i} 2^{4i} + a_{4i+1} 2 \cdot 2^{4i} + a_{4i+2} 2 \cdot 2^{4i} + a_{8i\ 3} 2^3 \cdot 2^4) \\ &= \sum_{i=0}^{n} a_{4i}(2+1)^i + a_{4i+1} 2(2+1)^i + a_{4i+2} 2^2(2+1) + \\ &\qquad a_{4i+3} 2^3(2+1) \end{aligned}$$

$$a \equiv a_o + 2\ a_1 + 2^2 a_2 + 2^3\ a_3 + (2+1)\ [a_4 + 2a_5 + 2^2 a_6 + 2^3 a_7] \bmod 13 \tag{44}$$

$$\equiv [a_o + 2\ a_1 + 2^2 a_2 + 2^3 a_3] + [a_4 + 2\ a_5 + 2^2 a_6 + 2^3 a_7] + 2\ [a_4 + 2a_5 + 2^2 a_6] + (2^2 + 1)\ a_7. \tag{45}$$

In Eq. (45) the final expression is less than 39, so it can be expressed as a 6-bit binary integer. Letting $a_0$, $a_1$, $a_{2j}$, $a_3$, $a_4$, $a_5$ now denote this integer, the final expression in Eq. (45) becomes Eq. (46)

$$a_o + 2a_1 + 2^2 a_2 + 2^3 a_3 + [a_4 + 2a_5]\ (2+1) \tag{46}$$

whose numerical value is less than 15+9=24, which can be expressed as a 5-bit number. Repeating the reduction again, Eq. (46) becomes Eq. (47).

$$a_p + 2a_1 + 2^2 a_2 + 2^3 a_3 + (2+1) a_4 \leqq 12 \tag{47}$$

These examples indicate that reduction modulo m to nearly the desired range of values can often be completed by a few bit-shifts, additions and computations when a≦about $m^2$.

Decoding

Suppose that there are binary representations of an integer modulo $m_1, m_2, \ldots, m_t$ and it is desired to find a binary representation of the integer modulo $m_1 m_2 \ldots m_t$ up to a multiple of $m_1 m_2 \ldots m_t$. The Chinese Remainder Theorem solves the general problem. Illustrating this are several examples.

Suppose $m_1 = 5$ and $m_2 = 7$. It will be observed that $m_1 = -2$ mod 7 and $3m_1 = 1$ mod 7. It will also be observed that $m_2 \equiv 2$ mod 5, so that $3m_2 \equiv 1$ mod 7. Then given integers $a_1$ and $a_2$, this integer $a = 3\ m_2\ a_1 + 3 m_1 a_2 = 21a_1 + 15a_2$ will have the property that $a \equiv a_1$ mod5 and $a \equiv a_2$ mod 7. Since $21 \equiv -14$ mod 35 and 14 has a simple binary expansion, the following is also true.

$$\begin{aligned} a &= -14a_1 + 15a_2 = (2^4 - 2)(-a_1) + (2^4 - 1)a_2 \\ &= 2^4(a_2 - a_1) + (2a_1 - a_2) \end{aligned} \tag{48}$$

(since $a_2' = a_2 + 7$ could be substituted for $a_2$ without changing a up to a multiple of 35, the recommended decoding would use the above formula (48) if $a_2 \geqq a_1$ and $$a = 24(a_2 + 7 - a_1) + [2a_2 + 7)] \text{ if } a_2 < a_1.) \tag{49}$$

Suppose $$m_1 = 5,\ m_2 = 7,\ m_3 = 13 \tag{50}$$

Then $$m_2 m_3 \equiv 1 \bmod 5$$

$$m_1 m_3 \equiv 2 \bmod 7 \text{ so that } 4m_1 m_3 \equiv 1 \bmod 7$$

$$m_1 m_2 \equiv -4 \bmod 13 \text{ so that } 3m_1 m_2 \equiv 1 \bmod 13$$

Therefore $$m_2 m_3 a_1 + 4m_1 m_3 a_2 + 3m_1 m_2 a_3 \tag{51}$$

would have the property that $$a \equiv a_i \bmod m_i,\ i = 1,2,3. \tag{52A}$$

Therefore $$\begin{aligned} a &= (2^3 - 1)(2^4 - 2 - 1)a_1 + 2^2(2^2 + 1)(2^4 - 2 - 1)a_2 + (2^2 - 1)(2^2 + 1)(2^3 - 1)\ a_3 \\ &= (2^4 - 2 - 1)[(2^3 - 1)a_1 + (2^4 + 2^2)a_2] + (2^4 - 1)(2^3 - 1)\ a_3 \end{aligned} \tag{52B}$$

-continued $$= (2^4 - 1)\,[(2^3 - 1)(a_1 + a_3) + (2^4 + 2^2)\,a_2] - 2\,[(2^3 - 1)a_1 + (2^4 + 2^2)a_2]$$

could be made the basis for decoding. The quantity $(2^2+2^4)\,a_2$ could be calculated with two shifts and one adder, with $a(2^3-1)\,a_1$ and $(2^3-1)(a_1+a_3)$ calculated in parallel. Then the two terms in brackets could be calculated. The first could then be obtained shifted and added. It would only remain to shift the last term and add to obtain "a" up to a multiple of $m_1m_2m_3$.

If r(n) and s(n) are written as $$r^{+}(n) - r^{-}(n) \tag{53}$$

and $$s^{+}(n) - s^{-}(n) \tag{54}$$

and these, in turn, are expressed in N bits, then $4N^2$ correlators are required, based on the square law identity required. If, however, r(n) and s(n) are first written as N-tuples of signed bits and these are written as a positive n-vector less another positive N-vector then the same $4N^2$ correlators can handle inputs of considerably larger dynamic range. Indeed, in the first case the largest integer which can be handled is $2^N-1$ while in the second case it is $(3^{N-1})/2$. Since the second approach is more efficient, it will now be described in detail.

Mathematically, it is desired to express an integer $$a = \sum_{i=0}^{M'} a_i 2^i \text{ with } 0 \leqq a_i \leqq 1 \tag{55}$$

$$\text{as } \sum_{i=0}^{M'} b_i 3^i \text{ with } -1 \leqq b_i \leqq 1 \tag{56}$$

Once this can be done, it is immediately apparent that -a can also be expressed in the same form.

The (M'+1)tuple $\tilde{b}=(b_0, b_1, \ldots, b_{M'})$ can be written as $\tilde{b}^{+}[=(b_0^{+}, b_1^{+}, \ldots, b_{M'}^{+})]-\tilde{b}^{-}[=(b_0^{-}, b_1^{-}, \ldots, b_{M'}^{-})]$, (57)

with $$b_i^{+} \cdot b_i^{-} \geqq 0 \text{ and } b_i^{+} \cdot b_i^{-} = 0 \text{ for all i.} \tag{58}$$

For reasonable M, this can readily be accomplished using a read-only memory (ROM). Thus the coder in FIG. 6 would consist of ROMs. The ROM for M'=3 will be described. Then $(3^{M'}-1)/2=13$, the pair of sequences for all integers between −13 and +13 must be specified. The ROM for non-negative inputs is:

TABLE 2

| Binary Representation of $\tilde{b}_+$ and $\tilde{b}_-$ | | | |
|---|---|---|---|
| a Natural Number | Input Representation Number | $\tilde{b}_+$ | $\tilde{b}_-$ |
| 0 | 0000 | 000 | 000 |
| 1 | 0001 | 001 | 000 |
| 2 | 0010 | 010 | 001 |
| 3 | 0011 | 010 | 000 |
| 4 | 0100 | 011 | 000 |
| 5 | 0101 | 100 | 011 |
| 6 | 0110 | 100 | 010 |
| 7 | 0111 | 101 | 010 |
| 8 | 1000 | 100 | 001 |
| 9 | 1001 | 100 | 000 |
| 10 | 1010 | 101 | 000 |

TABLE 2-continued

| Binary Representation of $\tilde{b}_+$ and $\tilde{b}_-$ | | | |
|---|---|---|---|
| a Natural Number | Input Representation Number | $\tilde{b}_+$ | $\tilde{b}_-$ |
| 11 | 1011 | 110 | 001 |
| 12 | 1100 | 110 | 000 |
| 13 | 1101 | 111 | 000 |

The negative of a number in Table 2 has $\tilde{b}_+$ and $\tilde{b}_-$ interchanged.

Now consider two N sequences of M' vector decomposed as just described into two vectors consisting of only non-negative components. Then $$c(n) = c_0(n), c_1(n), \ldots, c_{M'-1}(n) \tag{59}$$

$$d(n) = d_0(n), d_1(n), \ldots, d_{M'-1}(n) \tag{60}$$

with $$c_i(n) = c_i^{+}(n) - c_i^{-}(n) \tag{61}$$

and $$d_j(n) = d_j^{+}(n) - d_j^{-}(n). \tag{62}$$

The convolution $$\left[\sum_{i=0}^{M'-1} c_i(n)\, 3^{i}\right] * \left[\sum_{j=0}^{M'-1} d_j(n)\, 3^{j}\right] = \sum_{i=0}^{M'-1}\sum_{j=0}^{M'-1} [c_i(n) * d_j(n)]\, 3^{i+j} \tag{63}$$

Each convolution $c_i(n)*d_j(n)=$ $$\sum_{n=0}^{N-1} c_i(n) c_j(m-n) \tag{64A}$$

with the product $c_i(n)c_j(m-n)$ calculated using identity Eq. (7).

The decoding then proceeds in several steps. First the outputs $$\sum_{n=0}^{N-1} [c_i^{+}(n) + d_j^{+}(m-n)]^2,$$
$$\sum_{n=0}^{N-1} [c_i^{+}(n) + d_j^{-}(m-n)]^2,$$
$$\sum_{n=0}^{N-1} [c_i^{-}(n) + d_j^{+}(m-n)]^2$$
$$\sum_{n=0}^{N-1} [c_i^{-}(n) + d_j^{-}(m-n)]^2$$

are combined using two differential amplifiers 54 and a summer 56, as illustrated in FIG. 4. Next the resulting outputs proportional to $c_i(n)*d_j(n)$ are to be multiplied and summed to form c(n)*d(n). Thus $$c(n)*d(n) = \sum_{i=0}^{M'-1}\sum_{j=0}^{M'-1} (c_i(n)*d_j(n))\, 3^{i+j} = \sum_{k=0}^{2(M'-1)} \left(\sum_{i+j=k} c_i(n)*d_j(n)\right) 3^{k} = \sum_{k=0}^{2(M'-1)} c_k\, 3^{k} \tag{64B}$$

is calculated by determining the inner digital sum in signed binary (the assumed format of the output of the A/D converters in FIG. 5). Since the final output should also be in signed binary $3^k$ is replaced.

$$3^k=(2+1)^k=P_k(2) \quad (65)$$

$P_k(2)$ = the polynomial in powers of 2 with coefficients 0 or 1. (66)

For example, $$\begin{aligned}
3^0 &= 1 \\
3^1 &= 1+2 \\
3^2 &= 1 + 2^3 \\
3^3 &= 1+2 + 2^3 + 2^4 \\
3^4 &= 1 + 2^4 + 2^6 \\
3^5 &= 1+2 + 2^4 + 2^5 + 2^6 + 2^7 \\
3^6 &= 1 + 2^3 + 2^4 + 2^6 + 2^7 + 2^9
\end{aligned}$$

Observe for the case when $M'=4$ so that $2(M'-1)=6$ that the final summation and shift network depends on the order of the operations. Here for example one would form $$\begin{array}{lll}
(1)\ C_6+C_5 & (1)'\ (C_5+C_3) & (1)''\ C_6+C_3 \\
(2)\ C_6+C_5)+C_7 & (2)'\ (C_5+C_3)+C_1 & (2)''\ (C_6+C_3)+C_2 \\
(3)\ [(C_6+C_5)+C_7]+C_8 & (3)'\ (C_3+C_2) & (3)''\ (C_o+C_1) \\
(4)\ (C_3+C_2)+(C_o+C_1) & & \\
(5)\ [C_6+C_5)+C_7]+C_8+[(C_3+C_2)+(C_o+C_1)]. & &
\end{array}$$

Then one could calculate the unit place, which is determined by relation (5), add to this sum (2)′ shifted once to obtain two's digit and shifted twice to obtain the four's digit, add to this (2)″ shifted 3 times to obtain an eight digit, etc. Calculations (1), (1)′, and (1)″ could be accomplished in parallel, (2), (2)′, and (2)″) in parallel, etc. (Care would have to be taken so that the signs of the $c_k$ are taken into account.)

The radix 3 scheme thus described requires $4(M')^2$ correlators. If the correlations could accept a larger dynamic range, then a higher odd radix could be used.

For example, if radix 7 were used, then $$a = \sum_{i=0}^{M-1} a_i 7^i \text{ with } -3 \leqq a_i \leqq 3 \quad (67)$$

Here a ROM would be used to associate to each signed binary input a pair of M′ sequences consisting of elements which are pairs of binary bits representing the required integers 0,1,2, and 3. The D/A converters would then generate an output proportional to the numeral value of $a_i$ from the pair of binary bits representing it. The decoding would be similar to that described for radix 3, except the powers of 7 would be expressed as polynomials in 2. For example, $$7^0=1$$

$$7^1=2^2+2+2^0=2^2+2+1$$

$$7^2=2^5+2^4+1$$

etc.

Obviously, many modifications and variations of the present invention are possible in the light of the above teachings, and, it is therefore understood that within the scope of the disclosed inventive concept, the invention may be practiced otherwise than specifically described.

What is claimed is:

1. A convolver comprising:

a first, multi-tap, delay line at one end of which, for example the left end, is applied a signal s(n), the signals at the outputs of the various taps, starting from the left end, being s(0), s(1), . . . , s(N−1);

a second N-tap delay line, at the right end of which is applied a signal r(n), the outputs of this delay line, from the right end of the delay line, being r(0), r(1), . . . , r(N−1);

a plurality of N means for multiplying having two inputs, one input from each of the two delay lines, being paired as follows: the s(0)th tap of the first delay line and the r(N−1)th output of the second delay line being connected to the left most means for multiplying, the s(1)th output of the first delay line and the r(N−2)th output of the second delay line being connected to the second means for multiplying, etc.; each means for multiplying comprising:

a means for generating the signal corresponding to the square of the signal [s(n)+r(m−n)];

a means for generating the signal $s^2(n)$;

a means for generating the signal $r^2(m-n)$; and a means for taking the difference between the first-named signal and the other two signals to result in a remainder signal [2s(n)r(n−m).]2s(m)r(m−n); the convolver further comprising:

a means for adding the N outputs of the multipling means the output of the adding means being the summation from n=0 to N−1 of the quantity s(n)r(m−n); wherein:

all of the signals involved, including s(n), r(n) and s(n) r(m−n), are modulo numbers; and wherein the first and second delay lines, the multiplying means and the means for adding are implemented as charge-coupled devices.

2. The convolver according to claim 1, wherein the means for adding comprises:

a plurality of N/2 means for summing, each having two inputs which comprise outputs from two of the means for multiplying, each means for summing having an output;

a plurality of N/4 means for summing, having two inputs from two of the plurality of N/2 means for summing, each of the means for summing having an output, etc., the outputs of two summers being connected to other summers until there is only summer left having two inputs and one output.

3. A correlator structure comprising:

an even number plurality of convolvers similar to the convolver as described in claim 2;

a first means for rectifying, whose input signal is r(n) and whose output signals are $r^+(n)$ and $r^-(n)$, the $r^+(n)$ output being connected to the inputs of two first delay lines, the $r^-(n)$ output being connected to two other first delay lines;

a second means for rectifying, which converts an input signal s(n) into two output signals $s^+(n)$ and $s^-(n)$, the $s+(n)$ output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing whose two inputs comprise the outputs of the two differencing means and whose output is twice the summation.

4. A correlator structure comprising:

an even number plurality of correlators as described in claim 3, further comprising:

a first means for rectifying, whose input signal is r(n) and whose output signals are and $r^-(n)$, the $r^+(n)$ output being connected to the inputs of two first delay lines, the $r^-(n)$ output being connected to two other first delay lines;

a second means for rectifying, which converts an input signal s(n) into two output signal $s^+(n)$ and $s^-(n)$, the $s+(n)$ output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolvers;

a second means for differencing, whose two inputs are connected to the outputs of two means for adding of two other convolvers; and an output means for summing, whose two inputs comprise the outputs of the two differencing means and whose output is twice the summation.

5. A convolver comprising:

a first, multi-tap, delay line at one end of which, for example the left end, is applied a signal s(n), the signals at the outputs of the various taps, starting from the left end, being s(0), s(1), . . . , s(N−1);

a second N-tap delay line, at the right end of which is applied a signal r(n), the outputs of this delay line, from the right end of the delay line, being r(0), r(1), . . . , r(N−1);

a plurality of N means for multiplying having two inputs, one input from each of the two delay lines, being paired as follows: the s(0)th tap of the first delay line and the r(N−1)th output of the second delay line being connected to the left most means for multiplying, the s(1)th output of the first delay line and the r(N−2)th output of the second delay line being connected to the second means for multiplying, etc.; each means for multiplying comprising:

means for generating the signal corresponding to the square of the signal [s(n)+r(m−n)];

a means for generating the signal $s^2(n)$;

a means for generating the signal $r^2(m-n)$; and a means for taking the difference between the first-named signal and the other two signals to result in a remainder signal 2s(m)r(m−n); the convolver further comprising:

a means for adding the N outputs of the multiplying means, the output of the adding means being the summation from n=0 to N−1 of the quantity s(n)r(m−n); wherein all of the signals, including signals s(n), r(n) and s(n) r(m−n) correspond to radix numbers, excluding the radix 2 and 10; and wherein the first and second delay lines, the multiplying means and the means for adding are implemented as charge-coupled devices.

6. The convolver according to claim 5, wherein the means for adding comprises:

a plurality of N/2 means for summing, each having two inputs which comprise outputs from two of the means for multiplying, each means for summing having an output;

a plurality of N/4 means for summing, having two inputs from two of the plurality of N/2 means for summing, each of the means for summing having an output, etc., the outputs of two summers being connected to other summers until there is only summer left having two inputs and one output.

7. A correlator structure comprising:

an even number plurality of convolvers similar to the convolver as described in claim 6;

a first means for rectifying, whose input signal is r(n) and whose output signal are $r^+(n)$ and $r^-(n)$, the $r^+(n)$ output being connected to the inputs of two first delay lines, the $r^-(n)$ output being connected to two other first delay lines;

a second means for rectifying, which converts an input signal s(n) into two output signals $s^+(n)$ and $s^-(n)$, *the $s+(n)$ output signal being connected to two second delay lines, the $s^-(n)$ output signal being connected to two other second delay lines; the signals r(n), $r^+(n)$ and $r^-$*(n) and s(n), $s^+(n)$ *and $s^-$*(n) being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing whose two inputs comprise the outputs of the two differencing means and whose output is twice the summation.

8. A correlator structure comprising:

an even number plurality of correlators as described in claim 7, further comprising:

a first means for rectifying, whose input signal is r(n) and whose output signals are $r^+(n)$ and $r^-(n)$, the $r+(n)$ output being connected to the inputs of two first delay lines, the $r^-(n)$ output being connected to two other first delay lines;

a second means for rectifying, which converts an input signal s(n) into two output signals $s^+(n)$ and $s^-(n)$, the $s+(n)$ output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing, whose two inputs comprise the outputs of the two differencing means and whose output is twice the summation.

9. A correlator structure comprising:

an even number plurality of convolvers each convolver comprising:

a first, multi-tap, delay line at one end of which, for example the left end, is applied a signal s(n), the signals at the outputs of the various taps, starting from the left end, being s(0), s(1), . . . , s(N−1);

a second N-tap delay line, at the right end of which is applied a signal r(n), the outputs of this delay line, from the right end of the delay line, being r(0), r(1), . . . , r(N−1);

a plurality of N multipliers having two inputs, one input from each of the two delay lines, being paired as follows: the s(0)th tap of the first delay line and the r(N−1)th output of the second delay line being connected to the left most multiplier, the s(1)th output of the first delay line and the r(N−2)th output of the second delay line being connected to the second multiplier, etc.; wherein the means for multiplying comprises:

a means for generating the signal corresponding to the square of the signal [s(n)+r(m−n)];

a means for generating the signal $s^2(n)$;

a means for generating the signal $r^2(m-n)$; and a means for taking the difference between the first-named signal and the other two signals to result in a remainder signal 2s(n)r(n−m);

a means for adding the N outputs of the multipliers, the output of the adding means being the summation from n=0 to N−1 of the quantity s(n)r(m−n); the signals s(n), r(n) and s(n) r(m−n) being all modulo numbers; and wherein the means for adding comprises:

a plurality of N/2means for summing, each having two inputs which comprise outputs from two of the means for multiplying, each means for summing having an output;

a plurality of N/4 means for summing, having two inputs from two of the plurality of N/2 means for summing, each of the means for summing having an output, etc., the outputs of two summers being connected to other summers until there is only summer left having two inputs and one output; the correlator structure further comprising:

a first means for rectifying, whose input signal is r(n) and whose output signals are $r^+(n)$ and $r^-(n)$, the $r^+(n)$ output being connected to the inputs of two first delay lines, the $r^-(n)$ output being connected to two other first delay lines;

a second means for rectifying, which converts an input signal s(n) into two output signals $s^+(n)$ and $s^-(n)$, the s+(n) output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing whose two inputs comprise the outputs of the two differencing means and whose output is twice the summation;

the first and second delay lines, the multipliers and the means for adding being implemented as charge-coupled devices.

10. A correlator structure according to claim 9, further comprising:

a first means for rectifying, whose input signal is r(n) and whose output signals are and $r^-(n)$, the $r^+(n)$ output being connected to the inputs of two first delay lines, the $r^-(n)$ output being connected to two other first delay lines;

a second means for rectifying, which converts an input signal s(n) into two output signal $s^+(n)$ and $s^-(n)$, the s+(n) output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing, whose two inputs comprise the outputs of the two differencing means and whose output is twice the summation.

11. A correlator structure comprising:

an even number plurality of convolvers each convolver comprising:

a first, multi-tap, delay line at one end of which, for example the left end, is applied a signal s(n), the signals at the outputs of the various taps, starting from the left end, being s(0), s(1), . . . , s(N−1);

a second N-tap delay line, at the right end of which is applied a signal r(n), the outputs of this delay line, from the right end of the delay line, being r(0), r(1), . . . , r(N−1);

a plurality of N means for multiplying having two inputs, one input from each of the two delay lines, being paired as follows: the s(0)th tap of the first delay line and the r(N−1)th output of the second delay line being connected to the left most multiplier, the s(1)th output of the first delay line and the r(N−2)th output of the second delay line being connected to the second multiplier, etc.;

the means for multiplying comprising:

a means for generating the signal corresponding to the square of the signal [s(n)+r(m−n)];

a means for generating the signal $s^2(n)$;

a means for generating the signal $r^2(m-n)$; and a means for taking the difference between the first named signal and the other two signals to result in a remainder signal 2s(n)r(n−m);

a means for adding the N outputs of the multiplying means, the output of the adding means being the summation from n=0 to N−1 of the quantity s(n)r(m−n);

all signals, including signals s(n), r(n) and s(n) r(m−n) corresponding to radix numbers, excluding the radix 2 and 10; the means for adding comprising:

a plurality of N/2 means for summing, each having two inputs which comprise outputs from two of the means for multiplying, each means for summing having an output;

a plurality of N/4 means for summing, having two inputs from two of the plurality of N/2 means for summing, each of the means for summing having an output, etc., the outputs of two summers being connected to other summers until there is only summer left having two inputs and one output; the correlator structure further comprising:

a first means for rectifying, whose input signal is r(n) and whose output signal are $r^+(n)$ and $r^-(n)$, the $r^+(n)$ output being connected to the inputs of two first delay lines, the $r^-(n)$ output being connected to two other first delay lines;

a second means for rectifying, which converts an input signal s(n) into two output signals $s^+(n)$ and $s^-(n)$, the $s+(n)$ output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing whose two inputs comprise the outputs of the two differencing means and whose output is twice the summation; and wherein the first and second delay lines, the multipliers and the means for adding are implemented as charge-coupled devices.

12. A correlator structure comprising:

according to claim 11, further comprising:

a first means for rectifying, whose input signal is r(n) and whose output signals are $r^+(n)$ and $r^-(n)$, the $r+(n)$ output being connected to the inputs of two first delay lines, the $r^-(n)$ output being connected to two other first delay lines;

a second means for rectifying, which converts an input signal s(n) into two output signals $s^+(n)$ and $s^-(n)$, the $s+(n)$ output signal being connected to two second delay lines, the $s^-(n)$ output signal being connected to two other second delay lines; the signals r(n), $r^+(n)$ and $r^-(n)$ and s(n), $s^+(n)$ and $s^-(n)$ being defined by Equations (3), (4) and (5);

a first means for differencing, whose output signal comprises the difference of its two input signals, one input being connected to the output of an adding means of one of the convolvers, the other input being connected to the output of a means for adding of another convolver;

a second means for differencing, whose two inputs are connected to the outputs of two means for adding of two other convolvers; and an output means for summing, whose two inputs comprise the outputs of the two differencing means and whose output is twice the summation.

* * * * *